US006152811A

United States Patent [19]

Crosta

[11] Patent Number: 6,152,811

[45] Date of Patent: Nov. 28, 2000

[54] FABRIC RAISING MACHINE INCLUDING POSITIVELY ROTATIVELY CONTROLLED RAISING CYLINDERS

[76] Inventor: Emanuele Crosta, Corso Sempione, 67, 21052, Busto Arsizio (Varese), Italy

[21] Appl. No.: 09/109,293

[22] Filed: Jun. 30, 1998

[30] Foreign Application Priority Data

Sep. 4, 1997 [IT] Italy ..... MI97A2018

[51] Int. Cl.[7] ..... B24B 7/00

[52] U.S. Cl. ..... 451/178; 451/65; 474/101; 474/109; 26/27; 26/28

[58] Field of Search ..... 451/178, 65, 294, 451/362; 74/665 GE; 474/101, 109, 110, 111, 112; 26/27, 28, 29 R

[56] References Cited

U.S. PATENT DOCUMENTS 4,434,584 3/1984 Rasmussen .
4,481,739 11/1984 Suzuki et al. .
5,163,969 11/1992 Eschenbach .
5,167,053 12/1992 Brown .

*Primary Examiner*—Timothy V. Eley
*Assistant Examiner*—Willie Berry, Jr.
*Attorney, Agent, or Firm*—Hedman, Gibson & Costigan, P.C.

[57] ABSTRACT

The present invention relates to a fabric raising machine including positively controlled raising/grinding cylinders, which comprises a plurality of rotary working cylinders, circumferentially arranged on a rotary framework, and for each working cylinder, a toothed pulley, thereon are entrained a cylinder closed loop driving toothed belt and cylinder closed loop timing belt to synchronize the operations of the toothed pulleys with the teeth of the driving belt.

6 Claims, 2 Drawing Sheets

FABRIC RAISING MACHINE INCLUDING POSITIVELY ROTATIVELY CONTROLLED RAISING CYLINDERS

BACKGROUND OF THE INVENTION

The present invention relates to a fabric raising or grinding machine including positively controlled fabric raising or grinding cylinders.

Prior raising or grinding machines conventionally comprise a plurality of working cylinders which are circumferentially arranged on a supporting framework, which can turn about a rotary axis therefor.

The working cylinders, in particular, are rotatively driven by a trapezoidal belt, which has the drawback of modifying, as the operating temperature is increased, the friction coefficient, thereby causing the RPM's of the driven pulleys to change.

An analogous problem is due to the wear of the belts, which enter the pulley grooves with an increased depth, thereby changing their original contact diameter and, consequently, causing a variation of the RPM's of the driven pulleys, as well as of the working cylinders.

Moreover, with the trapezoidal belt driving system, since the mentioned trapezoidal belts have a very small contact with the pulleys of the working cylinders, it is not possible to provide raising forces above a given threshold, since the belts tend to inevitably slip with respect to their pulleys, thereby limiting the operating performance of the fabric raising machine and, accordingly, the raising effect thereof on the fabric being raised or ground.

In order to overcome the above mentioned drawbacks, fabric raising or grinding machines have been already constructed, including a positive drive system, comprising a plurality of gear elements which are mutually engaged with one another.

This type of driving system, however, has the drawback that it is very noisy and very complex construction-wise, thereby it has been practically abandoned.

SUMMARY OF THE INVENTION

Accordingly, the aim of the present invention is to overcome the above mentioned drawbacks, by providing a fabric raising machine including positively controlled raising cylinders, in which the transmission of the driving forces and/or movements is performed in a very simple manner, without any timing or synchronizing problems of the raising cylinders of the machine.

Within the scope of the above mentioned aim, a main object of the present invention is to provide such a raising machine, in which the positive driving of the raising cylinders provides the advantages of holding the operating set pattern constant, without modifying the number of revolutions of the individual working cylinders.

Another object of the present invention is to provide such a raising machine which allows to greatly increase the fabric raising force, which force is specifically set depending on the type of fabric material being raised, and without causing any slipping problems in the drive system of the machine.

Yet another object of the present invention is to provide such a fabric raising machine which, due to its specifically designed constructional features, is very reliable and safe in operation and which, moreover, is very competitive from a mere economic standpoint.

According to one aspect of the present invention, the above mentioned aim and objects, as well as yet other objects, which will become more apparent hereinafter, are achieved by a fabric raising machine including positively controlled raising cylinders, said raising machine comprising a plurality of fabric raising cylinders, which are circumferentially arranged on a rotary framework, characterized in that said raising machine comprises moreover, for each said raising cylinder, a toothed pulley, thereon are entrained a closed loop driving toothed belt and a closed loop toothed timing belt, in order to hold said toothed pulleys synchronized with the teeth of the driving belt.

BRIEF DESCRIPTION OF THE DRAWINGS

Further characteristics and advantages of the present invention will become more apparent hereinafter from the following detailed disclosure of a preferred, though not exclusive, embodiment of a fabric raising machine including positively controlled fabric raising cylinders, which is illustrated, by way of an indicative, but not limitative example, in the accompanying drawings, where.

DESCRIPTION OF THE PREFERRED EMBODIMENT

Figure 1:
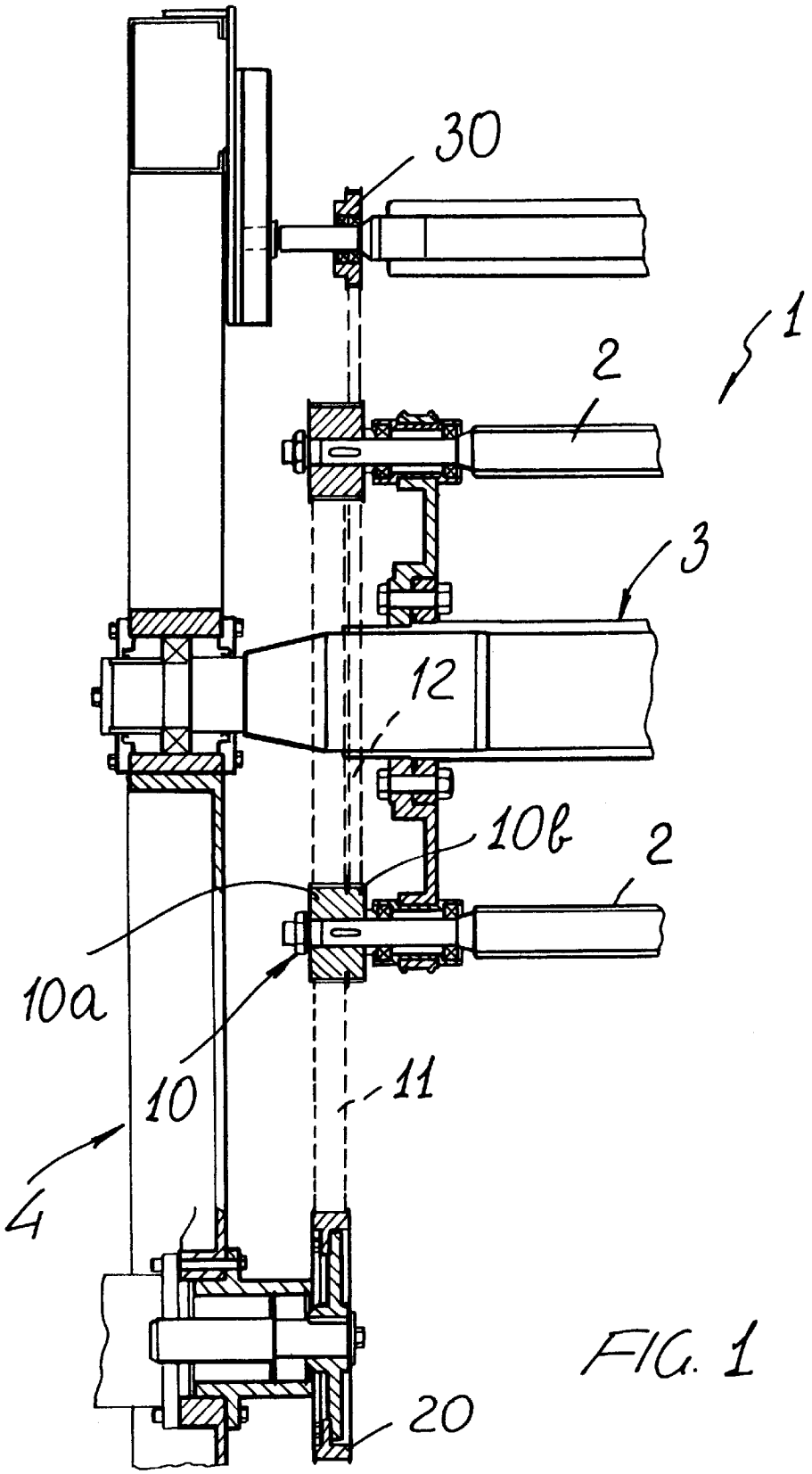
FIG. 1 is a cross-sectional view, substantially taken along a vertical plane, illustrating the raising or grinding machine according to the invention.
Figure 2:
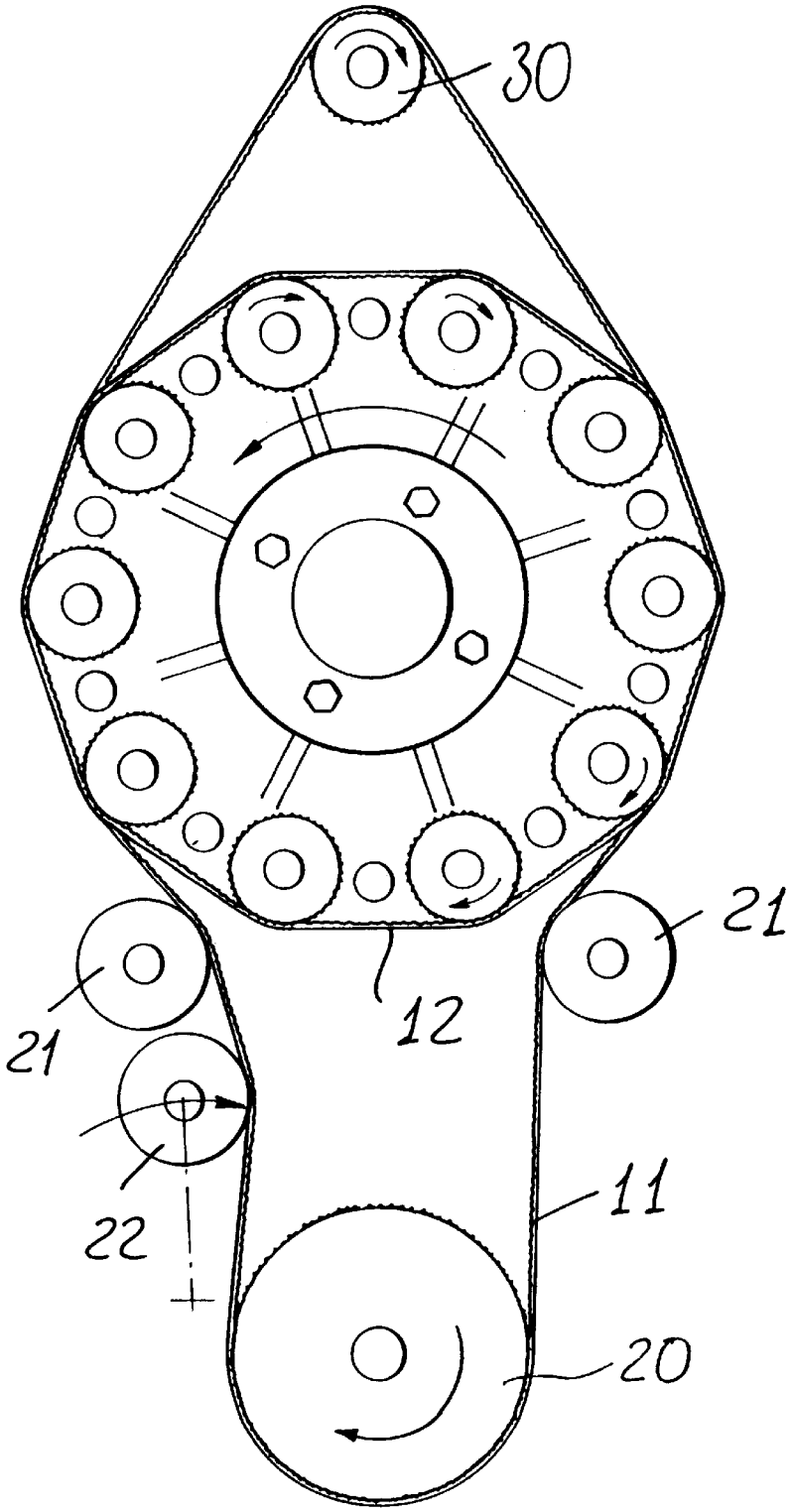
FIG. 2 illustrates a front view of the subject raising or grinding machine, as seen from the axial end portion of the working or raising cylinders thereof.

With reference to the number references of the above mentioned figures, the fabric raising or grinding machine, including positively controlled raising or grinding cylinders, according to the present invention, which has been generally indicated by the reference number 1, comprises a plurality of rotary working or fabric raising cylender 2 of any conventional suitable types, which are circumferentially arranged on a framework 3, which is rotatively supported by a fixed framework, schematically indicated by 4.

The main feature of the invention is that, at an axial end portion of each raising cylinder, a toothed pulley, indicated by the reference number 10, is provided, said toothed pulley including two discrete regions, respectively 10*a* and 10*b*, adjoining one another in the axial direction, which are respectively engaged with a closed loop driving toothed belt 11 and a related closed-loop toothed timing belt 12.

More specifically, the driving belt 11, which has a width larger than that of the timing or synchronizing belt 12, is entrained on a toothed driving pulley 20 and on switching pulleys 21, provided for a proper location of said belt, with respect to said working cylinders.

A belt tension roller 22, for holding the driving belt suitably tensioned is moreover provided.

The timing or synchronizing belt 12 is in turn entrained on the toothed pulleys at the region 10*b* thereof, adjoining the region 10*a* and on a synchronization tension pulley 30, which is arranged on the opposite side of the driving pulley 20 and being supported by a movable bar, in order to adjust the tension of the timing or synchronizing belt.

The provision of the two closed-loop toothed belts will allow to transmit to the raising cylinders 2 consequently to the fabric being raised thereby (not shown) a comparatively great raising or grinding force, while always holding a perfect synchronization with the toothed pulleys, thereby preventing the teeth from loosing their synchronization relationship susceptible to greatly damage the driving system.

The positive driving or transmission system, provides, with respect to a conventional trapezoidal belt driving system, the great advantage of holding the raising set pattern constant, while providing a much greater raising force than that which can be obtained by using conventional trapezoidal belts.

From the above disclosure it should be apparent that the invention fully achieves the intended aim and objects.

In particular, the fact is to be pointed out that the subject positive driving system allows to fully exploit the operating performance of the raising or grinding machine, by greatly reducing the fabric containing raising steps or passes, and consequently greatly increasing the machine yield.

The invention, as disclosed, is susceptible to several modifications and variations, all of which will come within the inventive scope.

Moreover, all the constructional details can be replaced by other technically equivalent elements.

In practicing the invention, the used materials, provided that they are compatible to the intended application, as well as the contingent size and shapes, can be any, depending on requirements.

What is claimed is:

1. A machine including a plurality of positively rotatively controlled fabric raising cylinders, circumferentially supported on a rotary framework, wherein said fabric raising machine comprises toothed pullys, coupled to each of said fabric raising cylinders, each said toothed pulleys having entrained a raising cylinder driving closed-loop toothed belt for simultaneously rotatively driving said raising cylinders and a raising cylinder timing closed-loop toothed belt for holding said toothed pulleys synchronized with said raising cylinder driving belt.

2. A machine, according to claim 1, wherein said toothed pulleys are coupled to an axial end portion of each said related fabric raising cylinder.

3. A machine, according to claim 1, wherein said driving belt has a toothed pulley engagement region larger than an engagement region of said timing belt with said toothed pulleys.

4. A machine, according to claim 1, wherein said fabric raising machine comprises moreover fixed switching elements operating on said driving belt to define said engagement region of said driving belt with said toothed pulleys.

5. A machine, according to claim 1, wherein said fabric raising machine comprises moreover a belt tension element engageable with said driving belt.

6. A machine, according to claim 14, wherein said fabric raising machine comprises moreover a synchronization tension pulley arranged on an opposite side from said driving belt.

* * * * *